United States Patent [19]

York

[11] 4,415,432

[45] Nov. 15, 1983

[54] HYDROCARBON RECOVERY METHOD AND APPARATUS

[75] Inventor: Earl D. York, Englewood, Colo.

[73] Assignee: Standard Oil Company (Indiana), Chicago, Ill.

[21] Appl. No.: 208,165

[22] Filed: Nov. 19, 1980

[51] Int. Cl.[3] ..... C10G 1/00; C10B 49/10

[52] U.S. Cl. ..... 208/11 R; 208/8 R; 201/31

[58] Field of Search ..... 208/11 R, 8 R; 201/31; 202/84, 99, 208, 215

[56] References Cited

U.S. PATENT DOCUMENTS

| | | | |
|---|---|---|---|
| 2,582,712 | 1/1952 | Howard | 208/8 R X |
| 2,654,698 | 10/1953 | Phinney | 208/8 R X |
| 2,711,387 | 6/1955 | Matheson et al. | 201/31 |
| 2,723,951 | 11/1955 | Minet | 208/8 R |
| 2,725,347 | 11/1955 | Leffer | 201/31 X |
| 3,140,240 | 7/1964 | Fowler, Jr. | 201/31 X |
| 3,251,751 | 7/1980 | Lindahl et al. | 208/8 R X |
| 3,442,789 | 5/1969 | Zimmerman, Jr. | 208/8 R |
| 3,562,115 | 5/1971 | Dunlop | 208/8 R X |
| 3,655,518 | 4/1972 | Schmalfeld et al. | 208/11 R |
| 3,839,186 | 10/1974 | Berger | 208/8 R |
| 3,884,649 | 6/1975 | Matthews | 201/31 X |
| 3,909,364 | 9/1975 | Singh | 201/31 X |
| 3,976,558 | 8/1976 | Hall | 201/31 X |
| 4,057,402 | 11/1977 | Patel et al. | 201/31 X |
| 4,082,615 | 4/1978 | Komuro et al. | 201/31 X |
| 4,312,740 | 3/1982 | Chiaramonte | 208/11 R |

*Primary Examiner*—Delbert E. Gantz
*Assistant Examiner*—Glenn A. Caldarola
*Attorney, Agent, or Firm*—Thomas W. Tolpin; William T. McClain; William H. Magidson

[57] ABSTRACT

Disclosed is an improved method and apparatus for the recovery of hydrocarbons from tar sands, oil shale or oil containing diatomaceous earth. The method comprises passing feed comprising tar sands, oil shale or oil containing diatomaceous earth to a contacting zone wherein the feed is contacted with heat transfer medium in a screw mixing zone to heat said feed to near recovery temperature wherein the feed is at least partially heated to form fluid material having heating value and forming partially spent inorganic matter associated with carbonaceous material; passing a mixture comprising substantially all of the fluid material and partially spent inorganic matter associated with carbonaceous material from the contacting zone to a separation zone wherein solids are partially separated from the fluid material; and recovering fluid material.

3 Claims, 1 Drawing Figure

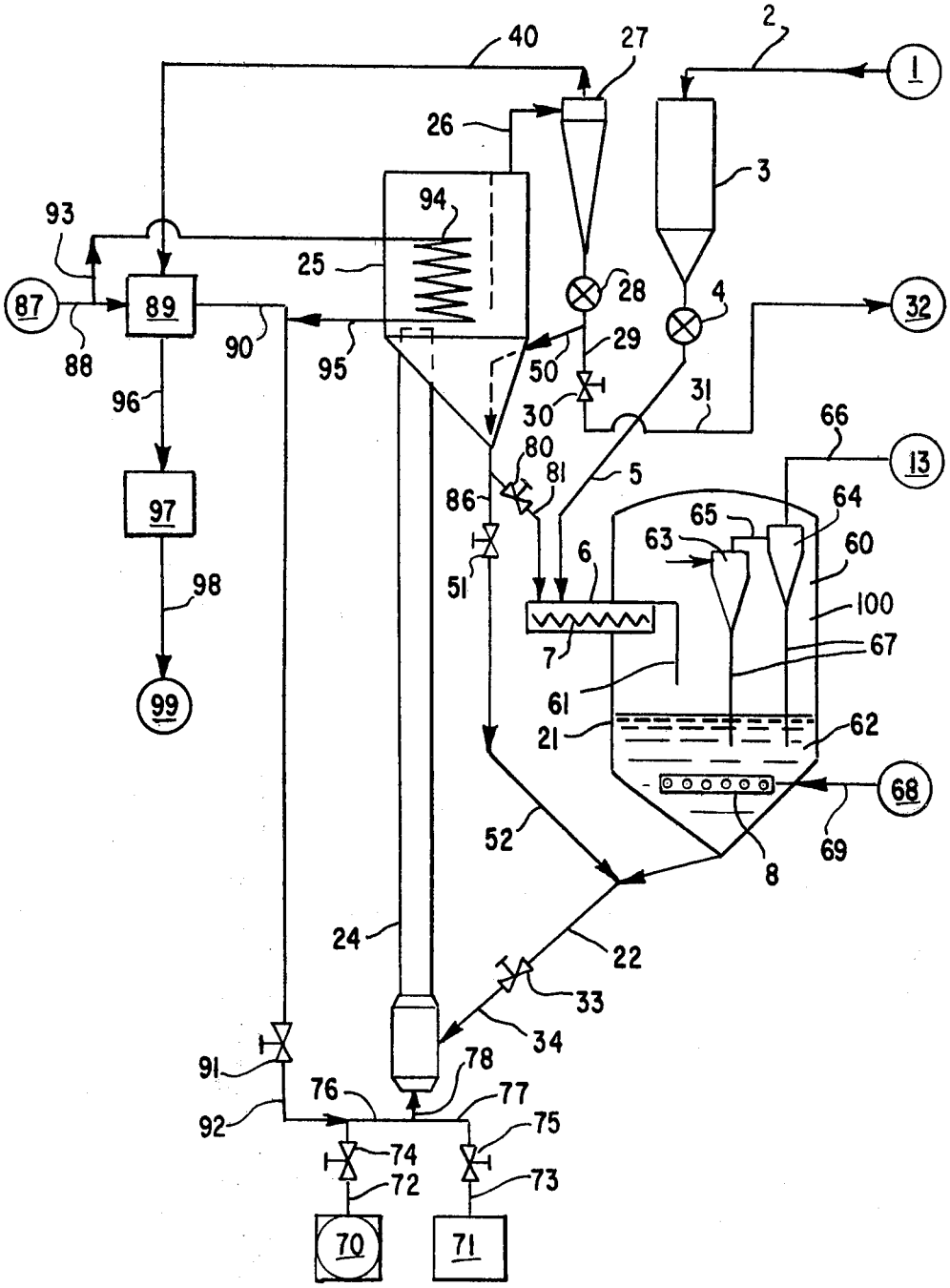
40
27
2
1
26
3
93
94
25
28
4
32
87
89
88
90
95
29
50
30
31
96
66
13
80
81
5
97
86
64
65
63
60
51
6
98
100
7
67
99
61
21
62
68
52
69
8
24
22
33
34
91
78
76
77
92
75
74
72
73
70
71

HYDROCARBON RECOVERY METHOD AND APPARATUS

BACKGROUND

This invention relates to an improved method and apparatus for the recovery of hydrocarbon from oil shale, tar sands and heavy oil containing diatomaceous earth.

The term "oil shale" refers to sedimentary deposits containing organic materials which can be converted to shale oil. Oil shale can be found in various places throughout the world, especially in the United States in Colorado, Utah, and Wyoming. Some especially important deposits can be found in the Green River formation in the Piceance Basin, Garfield and Rio Blanco counties, in Northwestern Colorado.

Oil shale contains organic material called kerogen which is a solid carbonaceous material from which shale oil can be produced. Commonly oil shale deposits have variable richness of kerogen content, the oil shale generally being stratified in horizontal layers. Upon heating oil shale to a sufficient temperature, kerogen is decomposed and liquids and gases are formed. These fluids contain heating values and comprise shale oil, carbon monoxide, carbon dioxide, hydrogen, light hydrocarbon gases, water, hydrogen sulfide, and others.

Bitumens are hydrocarbon materials of natural or pyrogenous origin frequently found in liquid, semisolid or solid form. Tar sands containing various types of bitumen hydrocarbons exist in various areas of the world as, for example, the heavy deposits of Athabasca tar sands existing in Canada. These sands contain large reserves of bitumen type hydrocarbon constituents. For example, the bitumens or oil in the sands may vary from about 5 to 21% weight percent and generally occur in an amount of about 12% weight percent. The gravity of this bitumen or oil ranges from about 6° to 10° API with an average value generally of about 8° API. These sands exist as beds ranging from about 100 to 400 feet thick below at least about 200 feet of overburden. A typical oil recovered from tar sands has an initial boiling point of about 300° F. and about 50 weight percent of the oil boils above about 950° F.

The term "tar sand" refers to a consolidated mixture. The sand in tar sand is mostly alpha quartz as determined from X-ray diffraction patterns. The bitumen or tar of the tar sands consists of a mixture of a variety of hydrocarbons and, if properly separated from the sand component, may be used as feedstock for the production of synthetic fuels and/or petrochemicals.

Tar sand deposits occur throughout the world, often in the same geographical areas as petroleum deposits. Significantly large tar sand deposits have been identified and mapped in Canada, Venezuela, and the United States. The Canadian tar sand deposits are known as the Athabasca tar sands and are located in the province of Alberta, Canada. The estimated reserves for the bitumen content in the Athabasca tar sands has been estimated to be approximately 900 billion barrels and, to date, is the only tar sand deposit in the world currently being mined and processed for the recovery of the bitumen content.

Analysis of the Athabasca tar sands indicates an average bitumen content of approximately 12–13% by weight. Importantly, the Athabasca tar sands also have a relatively high moisture content of approximately 3–5%, by weight, connate water. It has, therefore, been postulated by certain investigators that the equilibrium structure of the Athabasca tar sands consists of a sand mixed with but separated from the bitumen matrix by a film of connate water, the connate water surrounding each grain of sand. Accordingly, it is further postulated that the bitumen in the Athabasca tar sands has already been displaced from the sand grains by the connate water. Under these conditions, bitumen separation involves a relatively simple phase disengagement process whereby the bitumen phase is readily disengaged from the sand phase by the conventional hot water separation techniques.

A more comprehensive discussion of the Athabasca tar sands may be found in the literature including, for example, (1) E. D. Innes and J. V. D. Tear, "Canada's First Commercial Tar Sand Development," Proceedings of the Seventh World Petroleum Congress, Elsevier Publishing Co., 3, p. 633, (1967); (2) F. W. Camp, *The Tar Sands of Alberta Canada,* Second Edition, Cameron Engineering, Inc., Denver, Colo. (1974); and (3) J. Leja and C. W. Bowman, "Application of Thermodynamics to the Athabasca Tar Sands," *Canadian Journal of Chemical Engineering,* 46, p. 479, (1968).

Additionally, the following U.S. patents are a few of the patents which have been granted for apparatus for processes directed toward obtaining bitumen from tar sands: U.S. Pat. Nos. 1,497,607; 1,514,113; 2,871,180; 2,927,007; 2,965,557; 3,161,581; 3,392,105; 3,553,099; 3,560,371; 3,556,980; 3,605,975; 3,784,464; 3,847,789; 3,875,046; and 3,893,907.

According to a report by the Utah Geological and Mineral Survey, the State of Utah contains at least 25 billion barrels of bitumen in the form of Utah tar sands. This represents approximately 95% of the total mapped tar sand reserves in the United States. Although the Utah tar sand reserves appear small in comparison with the enormous potential of the Athabasca tar sands, the Utah tar sand reserves represent a significant energy resource when compared to the United States crude oil proven reserves (approximately 31.3 billion barrels) and the United States crude oil production of almost 3.0 billion barrels during 1976. Utah tar sands occur in six major deposits along the eastern edge of the state and bitumen content varies from deposit to deposit as well as within a given deposit. However, the current information available indicates that the Utah tar sand deposits average generally less than 10% bitumen by weight but have been found with a bitumen saturation of up to 17 percent by weight.

Importantly, unlike the Athabasca tar sands, Utah tar sands have been found to be so dry that no moisture content can be detected by standard analytical techniques. Accordingly, it is obvious that in the absence of connate water, the bitumen is directly in contact with and bonded to, the surface of the sand grains. In addition, tests have also determined that bitumen obtained from Utah tar sands is two orders of magnitude or about 100 times more viscous than bitumen obtained from Athabasca tar sands. Hence, processing of Utah tar sands must involve both bitumen displacement of the bonded bitumen from the sand grains and subsequent phase disengagement of the more viscous bitumen from the sand phase.

Another type of hydrocarbon bearing material similar to tar sands is heavy oil containing diatomaceous earth. Diatomaceous earth contains siliceous remains of marine life and has been found in association with crude oil, such as that found in California's McKittrick field, and reported in The Oil and Gas Journal, Dec. 18, 1978.

Oil can be recovered from these hydrocarbon bearing materials, oil shale, tar sands and oil containing diatomaceous earth, by thermal processes. Heating these materials to suitable temperature can result in oil being formed or released.

For example, oil shale can be retorted to form a hydrocarbon liquid either by in situ or surface retorting. In surface retorting, oil shale is mined from the ground, brought to the surface, crushed, and placed in vessels where it is contacted with hot heat transfer medium, such as hot shale or gases, or mixtures thereof, for heat transfer. The resulting high temperatures cause shale oil to be freed from the oil shale forming a partially spent oil shale comprising inorganic material and carbonaceous material commonly referred to as coke. The coke may be deposited on the surface of the shale particles and also within the shale particles. In addition to the coke, partially retorted kerogen, commonly referred to as bitumen, may be present. The carbonaceous material can be burned by contact with oxygen at oxidation temperatures to recover heat and to form a spent oil shale relatively free of carbon. Spend retorted oil shale which has been depleted in carbonaceous material is removed from the reactor and discarded. One well-known method of surface retorting is the Lurgi-Ruhrgas process.

In the Lurgi type retort, raw fresh shale is fed into a mixer wherein it is contacted with hot spent or partially spent shale. The combined oil shales are then fed into a zone for additional residence time. Shale oil which has been retorted from the oil shale is separated from the shale. The Lurgi process generally passes vapors from the screw mixer to product recovery, and solids from the screw mixer to a separation where additional hydrocarbon is recovered. The oil is recovered and the spent and partially spent shale is passed to a zone wherein carbon is burned off the shale. This can be done by introducing oxygen containing gas such as air or diluted oxygen, and sometimes additional fuel to the zone to combust the carbon. A preferred method is to pass the spent and partially spent shale, and air or air and fuel upwardly through a vertical elongated reactor such as a lift pipe. After oxidation, a portion of the spent shale is then removed from the flue gas from said zone, for example by electrostatic precipitators, and used for the manufacture of solid masses. Another portion of the spent shale is fed to the mixer to transfer heat to fresh oil shale. This process is more fully described in U.S. Pat. No. 3,655,518 which is incorporated by reference and made a part hereof.

During retorting, oil vapor leaves the solid mass as a saturated vapor (dew point) in both the screw mixer and surge hopper. If heat is lost, the higher boiling portion of the vapor can condense on spent shale, resulting in cracking and coking and lower liquid yield.

The mixture of solids from the screw mixer passing into the surge bin can cause countercurrent flow of spent solids and vapor, and lead to entrainment of heavy oil with the solids decreasing oil yield.

Positioning cyclone separators too far from the retorting zone, or in places where cyclone cooling occurs, can lead to oil condensation, and oil coking and cracking.

It is an object of this invention to provide an improved method and apparatus for the recovery of oil from oil shale, tar sands or oil containing diatomaceous earth.

It is an object of this invention to provide a hydrocarbon recovery process which minimizes heat loss and coking.

It is further an object of this invention to minimize oil condensation on solids and to maximize oil yield.

SUMMARY OF THE INVENTION

The objects of this invention can be attained by an improved method and apparatus for the recovery of hydrocarbons from tar sands, oil shale or oil containing diatomaceous earth comprising passing feed comprising tar sands, oil shale or oil containing diatomaceous earth to a contacting zone wherein the feed is contacted with heat transfer medium comprising hot spent feed in a screw mixing zone to heat said feed to near recovery temperature. Spent feed is feed from which substantial amounts of hydrocarbon have been removed. Commonly spent feed contains less than above five weight percent hydrocarbon. At least a portion of the feed is heated to form fluid material having heating value and forming partially spent inorganic matter associated with carbonaceous material. A mixture comprising substantially all of the fluid material and partially spent inorganic matter associated with carbonaceous material from the contacting zone is passed to a separation zone wherein solids are partially, preferably substantially, separated from the fluid material. Fluid material is also recovered.

At least a portion of the partially spent inorganic matter associated with carbonaceous material can be passed to a combustion zone wherein it is contacted with oxidizing gas comprising oxygen to substantially combust carbonaceous material forming spent inorganic matter. At least a portion of the spent inorganic matter from the combustion zone can be recycled to the contacting zone.

The heat transfer medium can comprise hot spent oil shale, tar sands or diatomaceous earth or other materials such as sand, sometimes in conjunction with hot gases. Generally when the heat transfer medium comprises hot spent oil shale the fluid material formed comprises shale oil. When the heat transfer medium comprises hot spent tar sands, the fluid material formed generally comprises tar sands oil. In a like manner, when the heat transfer medium comprises hot spent diatomaceous earth, the fluid material generally comprises petroleum crude.

The separation zone often contains one or more cyclone separators in series for the separation of solids from fluids. A stripping fluid can be introduced into the separation zone to aid removal of fluid material from solids. Such stripping fluid can comprise steam, inert gas or recycled light hydrocarbon gases such as $C_3$ minus. Steam may be the cheapest stripping fluid but may result in contaminated water for disposal, or process use such as for steam in the lift heater. Steam can be introduced in excess of about 400° F., preferably in excess of about 600° F.

The separation zone can comprise a solids enriched phase and a solids dilute phase wherein the inlet to the cyclone or cyclones is positioned in the solids dilute phase. Stripping steam can be introduced into the solids enriched phase.

The improved method can comprise passing feed comprising crushed oil shale into a contacting zone wherein the feed oil shale is contacted with a heat transfer medium comprising spent oil shale in a screw mixer to heat said feed oil shale to near retorting temperature of about 400° C. to about 550° C. Retorting of the oil shale is substantially effected to form fluid material having heating value comprising shale oil and forming partially spent oil shale comprising inorganic material and carbonaceous coke. Substantially all of the fluid material, heat transfer medium and partially spent oil shale from the contacting zone is passed to a separation zone wherein solids are partially separated from the fluid material. Fluid material is recovered and at least a portion of the partially spent oil shale is passed to a fluid bed combustion zone wherein the partially spent oil shale is contacted with oxidizing gas at a temperature from about 650° C. to about 850° C. to substantially combust the coke and form spent oil shale. The spent oil shale may be cooled and at least a portion of the spent shale from the cooling zone is passed to the contacting zone. Tar sands and diatomaceous earth are treated in a similar manner.

The improved apparatus for the recovery of hydrocarbons comprises a screw mixer contacting zone wherein solid feed is contacted with heat transfer medium to heat said feed to a temperature sufficient to recover hydrocarbon, and at least partially effecting retorting of the feed to form fluid material having heating value and forming inorganic material in association with carbonaceous material; a separation zone wherein substantially all of the fluid material and the inorganic material from the contacting zone is passed for partial separation of solids from fluid material; and a combustion zone wherein the inorganic material in association with carbonaceous material is contacted with oxidizing gas comprising oxygen and steam to substantially combust carbonaceous material forming spent cementation properties. The separation zone may contain one or more cyclone separators for the separation of solids from fluids. Locating cyclones inside the separation zone in the solids dilute phase keeps the cyclones hot, and minimizes oil condensation, coking and cracking. An introduction means provides a stripping fluid such as steam into the separation zone, preferably into the solids enriched phase, in an amount sufficient to aid removal of fluid material from solids. The separation zone can comprise a lower zone for a solids enriched phase and an upper zone for a solids dilute phase. The inlet to the cyclone or cyclones is positioned in the solids dilute phase and the solids outlet of the cyclone or cyclones is positioned in or near the solids enriched phase. One or more baffles are provided in the separation zone to minimize the passage of solids from the contacting zone into the solids dilute phase. Preferably the outlet end of the screw mixing zone feeds directly into the solids dilute phase of the separation zone, and the baffling directs solids downward toward the solids enriched phase while allowing gases and vapors to pass into the solids dilute phase. It is preferred to arrange the introduction of materials from the screw mixer so that hydrocarbon vapors may readily pass into the solids dilute phase without substantial contact with the solids enriched phase, thereby minimizing entrainment, cracking and coking of hydrocarbon. Directing solids from the screw mixer toward the solids enriched phase reduces the quantity of dust in the solids dilute phase and reduces the lead on the cyclones.

The process will be described more thoroughly in regard to oil shale feed, however, the process is suitable for a variety of different feed materials.

Feed oil shale is generally crushed to suitable size for contact with a heat exchange medium. It is generally desirable to crush the shale to a size sufficient to insure easy handling and rapid heat exchange. Some processes provide that the feed oil shale have a particle size less than about one half an inch in diameter.

The feed oil shale can have a wide range of kerogen content, often ranging from about 10 to about 90 gallons per ton by the Fischer Assay Technique. However, it is generally preferable to retort shales containing at least about 20 gallons per ton.

Most oil shales begin to retort at temperatures in excess of about 350° C. In order to insure relatively fast retorting and minimize coke formation it is preferable to conduct retorting from about 400° C. to about 550° C. At substantially higher temperatures the shale oil undergoes excessive cracking a coke formation and reduces liquid yield.

The retorting takes place in the screw mixer contacting zone and in a separation zone in conjunction with the contacting zone which provides suitable reaction time to effect substantial retorting. It is desirable to remove as much hydrocarbon from the rock as is economically feasible. Generally at least 80 percent of Fischer Assay is recovered and in some cases recovery in excess of 100 percent is possible. Even though the feed shale is substantially retorted, the partially spent shale from the retorting process will contain carbonaceous material such as coke. Coke is a carbonaceous material having a low hydrogen to carbon ratio and low solubility in most hydrocarbon solvents. After retorting it is very common for the partially spent shale to have coke on or in the inorganic matrix of the shale. Commonly partially spent shale will contain about 2 to about 10 weight percent carbon. The amount of carbon on partially spent oil shale is a function of shale type and richness, and retorting conditions such as temperature, contact time and heat transfer efficiency.

Retorting of oil shale can be conducted to provide a variety of fluid products, both gases and liquids. The mixture of gases and liquids can be varied somewhat by controlling or modifying reaction parameters especially temperature. Some of the products which are formed are shale oil; light hydrocarbon gases such as methane, ethane, ethene, propane, propene and the like; hydrogen; carbon dioxide; carbon monoxide; hydrogen sulfide; ammonia; and others. It is generally desirable to maximize liquid yield and minimize the amount of lower valued product gases formed.

Partially spent oil shale from the contact area and retorting zone is passed to a combustion zone where the carbonaceous material on or in the partially spent shale is oxidized. Most commonly combustion zones are fluidized beds or transport reactors wherein partially spent shale is contacted with an oxygen-containing gas to oxidize carbon to carbon dioxide and a minor amount of carbon monoxide. The oxidation zone can have numerous shapes and configurations. The most important considerations are to achieve good contacting with oxygen and achieve reasonable temperature control. One preferable configuration for a combustion zone is an elongated upflow fluid bed or transport reactor wherein oxygen-containing gas is passed upwardly from near the bottom of the zone. The partially spent oil shale is introduced near the bottom of the combustion zone and maintained in the fluid state by a suitable gas velocity. The gas velocity should be sufficient to lift the particles on the desired paths, generally at a gas rate of at least about 25 feet/second. However combustion in some fluid beds can be conducted at substantially lower gas velocities. Carbon on the particles is combusted as the particles pass upwardly. The temperature of the gases and solids rise substantially as they are passed upwardly. The combustion zone can be operated at temperatures in excess of about 600° C., preferably in the range of about 700° C. to about 850° C. At temperatures too low the oxidation of the carbon proceeds at too low a rate and carbonate decomposition is lower. Temperatures higher than 800° C. can cause sintering of the shale and also require special materials for the high temperature. At sufficiently high temperatures, exothermic inorganic mineral reactions involving silica can occur, which could result in uncontrolled heat release and temperature increase.

The oxidizing gas comprises an oxygen-containing gas such as air, or oxygen in conjunction with various diluents such as nitrogen, $CO_2$ or other gases. The oxygen containing gas generally comprises about 5 to about 25 mol percent, preferably about 10 to about 20 mol percent, oxygen. It is also preferable for the oxidizing gas to contain steam which enhances the oxidation process and results in a spent shale having superior properties. Oxidizing gas comprising about 1 to about 75 mol per cent, preferably about 25 to about 50 mol percent, steam will accelerate reaction leading to improved cementation properties of the spent shale.

After the partially spent shale is oxidized in the combustion zone spent oil shale is formed having an extremely low carbon content. Spent oil shale commonly has a carbon content less than about 1.0 weight percent, preferably less than 0.2 weight percent. At least a portion of the spent oil shale from the combustion zone can be passed to the cooling zone. Generally, about 10 to about 100 weight percent, preferably about 30 to about 100 weight percent of the spent shale from the combustion zone is passed to the cooling zone. Because spent oil shale must be removed from the retorting process in order to prevent solids buildup, it is desirable to remove spent shale from downstream of the combustion zone. Therefore, it may be desirable to remove some of the spent oil shale prior to passing such shale to the cooling zone. The spent oil shale from the combustion zone has improved cementation properties and need not be passed to the cooling zone for further treatment. However, it may be desirable to pass such shale to either the cooling zone or some other zone for heat recovery.

About 10 to about 100 weight percent, preferably about 70 to about 100 weight percent of the spent shale from the cooling zone is passed to the contacting zone. Spent oil shale can be removed from the process downstream of the cooling zone for disposal; however, it is generally preferable to pass essentially all of the spent oil shale from the cooling zone to the contacting zone. The cooling zone reduces the temperature of the spent shale from the combustion zone by about 1° C. to about 100° C. Preferably, the cooling zone reduces the temperature of the spent shale by about 10° C. to about 50° C. The cooled shale which is still quite hot is passed to the contacting zone where it transfers heat to feed oil shale and heats the shale towards its retorting temperature.

THE DRAWING

The attached drawing is a schematic representation of one of the embodiments of this invention.

Raw shale 1 crushed to a particle size of less than about a half inch in diameter is passed through line 2 to feed hopper 3. The feed hopper is a large container for storing a suitable amount of feed for the process. The crushed feed shale from feed hopper 3 is passed by gravity through valve 4 through line 5 where it is passed into one end of a mixing zone 6. This mixing zone contains a screw mixer 7 which is characteristic of a Lurgi-type process.

Hot spent shale from collecting bin 25 is passed through valve 80 through line 81 to mixing zone 6 where it is thoroughly mixed with raw feed shale and heats at least a portion of the feed to retorting temperature. Much of the retorting takes place within mixing zone 6. However, because of relatively short residence times, the mixture of hot spent shale and partially retorted shale or feed shale passes from the end of the contacting zone into separation zone 21 where additional contact time and retorting occurs. Baffling 61, positioned near the outlet of the screw mixer, directs the solids emanation from the screw mixer in a downward direction to minimize the mixing of solids entering the separation zone and vapors passing upwardly in the separation zone. This minimizes the entrainment of partially spent shale in the oil vapor.

Two phases are formed in separation zone 21, a lower solids enriched phase 62 and an upper solids dilute phase 60. It is preferable that baffle 61 direct solids entering the separation zone to the solids enriched phase. Because of the relatively high temperatures involved, retorting at about 400° C. to about 550° C., the oil formed is in the vapor or mist state. The oil in the gaseous or mist state and light hydrocarbons, hydrogen sulfide, ammonia and various other off gases pass upwardly to cyclone separator 63, line 65 and cyclone separator 64 for the partial removal of finely divided dust and spent shale. The down pipes 67 from cyclones 63 and 64 preferably extend downwardly into solids enriched phase 62. The product stream passes from cyclone 64 to line 66 for further purification and recovery 13.

Separation zone 21 contains stripping fluid introduction means 8, a slotted pipe distributor, perforated pipe, or similar distributor within solids enriched phase 62. Stripping fluid such as steam 68 can be passed through line 69 to means 8 which uniformly distributes the fluid into the separation zone at sufficient volume and velocity to aid removal of hydrocarbons and gases from the solids in the solids enriched phase. Separation zone 21 contains a mixture of partially spent shale from retorting and also finely divided spent shale which was used as a heat transfer medium. The solids mixture from separation zone 21 generally passes through line 22 and valve 33 and line 34 to near the base of an elongated vertical lift pipe combustion zone 24. Air, preheated to over 300° C. is provided through line 90 through valve 91 and lines 92 and 76 for blending with steam 71 which is passed through line 73, valve 75 and line 77 where it is combined with the air. Additional air may be provided through line 72 and valve 74. The air and steam are combined in line 78 and passed into the base of the lift heater. The velocity of this mixture of air and steam is sufficient to pass the solids from line 34 upwardly through the lift pipe at a velocity to transport the solid phase and substantially effect combustion of the carbonaceous material on or in the inorganic matrix. The mixture of combustion gases and spent shale is passed into a collecting bin 25 where a portion of the spent shale is collected for recirculation back to the mixing zone 6. The collecting bin also provides line 86, valve 51 and line 52 to provide for the passage of spent shale in excess of that needed for circulating material to disposal 65.

Gases from the lift pipe are passed through collecting bin 25 through line 26 to cyclone 27. If inventory in the collecting bin is low, fines from cyclone 27 are recycled through line 17 to the collecting bin 25. Flue gas and discharged spent shale ash flow through line 40 to air preheater 89, line 96 to waste heat recovery 97, line 98 and finally separation 99, where flue gas and spent shale ash are separated by cyclones and/or electrostatic precipitators. In the event that dust loadings are too great to be handled in the heat recovery section, items 40, 89, 96, 97 and 98, dust can be removed from the system via line 29, valve 30 and line 31 for disposal 32.

Introduction of steam 71 at the base of lift heater 24 also provides for humidification of the off gas stream passing through line 40 which will aid in the removal of very finely divided dust by electrostatic precipitators.

Collecting bin 25 contains cooling zone 94 which provides for the cooling of spent shale from combustion zone 24. The spent shale is cooled by about 1° to about 100° C., preferably from about 10° to about 50° C. in the cooling zone. The cooled spent shale is normally recycled through valve 80 and line 81 to contacting zone 6 for contact with feed oil shale. The cooling zone can also be located in the line between the collecting bin and the screw mixer.

The cooling zone 94 within collecting bin 25 consists of a multiplicity of parallel pipes through which air is circulated for cooling the spent shale ash. This cooling will permit adjusting the circulation rate of the heat carrier to the screw mixer 7, thereby controlling the size of the material or permit burning spent shale with more coke without exceeding temperature limitations in the equipment.

Hot flue gas from line 26, cyclone 27, and line 40 pass to heat exchanger 89 which is used to preheat feed air for the combustion zone 24. Offgases from heat exchanger 89 are passed through line 96 to high pressure steam generator 97 and through line 98 to disposal 99.

Compressor 87 provides air through line 88 to heat exchanger 89 where it is used to recover heat from offgases and also be preheated itself for use in combustion zone 24. Compressor 87 also passes air through lines 88 and 93 to cooling zone 94 for the cooling of spent shale and also for the preheating of the air for use in the combustion zone. Preheated air from zones 89 and 94 are passed through lines 90 and 95, respectively, through valve 91 and line 76 for introduction near the bottom of elongated combustion zone 24. Stream is preferably mixed with the preheated air in line 78 to provide a more suitable environment for oxidation and carbonate conversion within the oxidation/combustion zone.

I claim:

1. An improved method for recovering hydrocarbons from tar sands, oil shale and oil containing diatomaceous earth, comprising the steps of:

partially retorting raw, solid hydrocarbon-containing material selected from the group consisting of tar sands, oil shale and oil containing diatomaceous earth, in a retort defining a contacting zone by contacting said raw, solid hydrocarbon-containing material in said contacting zone with a heat transfer medium consisting essentially of spent solid hydrocarbon-containing material selected from the group consisting essentially of spent tar sands, spent oil shale and spent oil containing diatomaceous earth, at a sufficient temperature to liberate hydrocarbons comprising light hydrocarbon gases and oil selected from the group consisting of tar sands oil, shale oil, and oil derived from oil containing diatomaceous earth, from said raw, solid hydrocarbon-containing material;

passing said partially retorted, solid hydrocarbon-containing material, said spent hydrocarbon-containing material, and said liberated hydrocarbons from said retort to a container defining a separation zone;

substantially completing retorting of said partially retorted solid hydrocarbon-containing material in said separation zone;

substantially separating said liberated hydrocarbons from said solid material in said separation zone, including passing said liberated hydrocarbons through at least one cyclone located within said separation zone;

passing said solid material from said separation zone to a combustor including a lift pipe defining a combustion zone at a location spaced substantially away from said retort;

substantially combusting said solid material in said lift pipe at said location spaced away from said retort to form said sent material;

withdrawing said liberated hydrocarbons from said separation zone; and feeding a preheated oxygen-containing gas injected with 25 mol% to 50 mol% steam into said combustion zone to enhance combustion of said solid material.

2. The method of claim 1 wherein said raw solid hydrocarbon-containing material is partially retorted in a screw mixer retort, said solid material is baffled downwardly in said separation zone to substantially minimize entrainment of said solid material in said liberated hydrocarbons, and said separating includes stripping said liberated hydrocarbons from said solid material with a stripping gas selected from the group consisting of steam and said light hydrocarbon gases to aid in said separation of said liberated hydrocarbons from said solid material.

3. An improved method for retorting oil shale, comprising the steps of:

partially retorting crushed raw oil shale in a screw mixer defining a contacting zone with a solid heat transfer medium comprising spent oil shale at a sufficient temperature to liberate hydrocarbons from said raw oil shale;

passing said shale and liberated hydrocarbons to a container defining a separation zone located downstream of said screw mixer;

substantially completing retorting of said raw oil shale in said separation zone to liberate most of the remaining hydrocarbons from said raw oil shale, leaving partially spent oil shale comprising inorganic material and carbonaceous coke;

separating said liberated hydrocarbons from said shale in said separation zone so that said liberated hydrocarbons are substantially in a solids dilute phase in an upper portion of said separation zone and said shale is substantially in a solids enriched phase in a lower portion of said separation zone;

partially dedusting said liberated hydrocarbons in a series of cyclones substantially located in said solids dilute phase to help minimize oil condensation, coking and cracking, said liberated hydrocarbons entering an inlet of said cyclones located in said solids dilute phase and said shale exiting said cyclones at a location in proximity to said solids enriched phase;

baffling said shale generally downwardly towards said solids enriched phase in said separation zone to substantially reduce the load on said series of cyclones in said separation zone;

preheating steam to at least 400° F.;

enhancing said separation of said liberated hydrocarbons from said shale by injecting said preheated steam t a temperature of at least 400° F. into said separation zone to strip said liberated hydrocarbons from said shale;

removing said dedusted hydrocarbons from said separation zone;

passing at least a portion of said partially spent oil shale from said separation zone to a lift pipe defining a fluid bed combustion zone spaced externally remote from said screw mixer;

combusting said oil shale only in said combustion zone with an oxidizing gas to form spent oil shale;

feeding at least a portion of said spent oil shale from said combustion zone to said screw mixer defining said contacting zone;

preheating said steam to at least 600° F. for use in said stripping; and said oxidizing gas comprising a preheated oxygen-containing gas injected with 25 mol% to 50 mol% steam to enhance said combustion.

* * * * *

UNITED STATES PATENT OFFICE

CERTIFICATE OF CORRECTION

Patent No. 4,415,432 Dated November 15, 1983

Inventor(s) EARL D. YORK

It is certified that error appears in the above-identified patent and that said Letters Patent are hereby corrected as shown below:

| Patent Column | Line | | | |
|---|---|---|---|---|
| 5 | 65 | "lead" | should be | --load-- |
| 9 | 53 | "stream" | should be | --steam-- |
| 10 | 30 | "sent" | should be | --spent-- |
| 11 | 19 | "t" | should be | --at-- |

Signed and Sealed this

First Day of May 1984

[SEAL]

Attest:

GERALD J. MOSSINGHOFF

Attesting Officer

Commissioner of Patents and Trademarks